United States Patent [19]

Hastings et al.

[11] 3,944,239

[45] Mar. 16, 1976

[54] MODIFIED SNOW SKI

[76] Inventors: Bernard Lyle Hastings, 110 Wheeler Road, Wethersfield, Conn. 06109; Arnold Sprung, 339 Cedar Drive West, Briarcliff Manor, N.Y. 10510

[22] Filed: Mar. 28, 1975

[21] Appl. No.: 563,415

[52] U.S. Cl. ..... 280/11.13 E

[51] Int. Cl.[2] ..... A63C 5/04

[58] Field of Search 280/11.13 E, 11.13 J, 11.13 U, 280/11.13 N, 11.13 P, 11.13 Q, 11.37 E, 11.13 Y

[56] References Cited

UNITED STATES PATENTS

| | | | |
|---|---|---|---|
| 3,063,728 | 11/1962 | Patterson | 280/11.13 J |
| 3,134,604 | 5/1964 | Aublinger | 280/11.13 J |

FOREIGN PATENTS OR APPLICATIONS

| | | | |
|---|---|---|---|
| 260,884 | 8/1949 | Switzerland | 280/11.13 J |

*Primary Examiner*—Robert R. Song
*Assistant Examiner*—Milton L. Smith
*Attorney, Agent, or Firm*—Burgess, Dinklage & Sprung

[57] ABSTRACT

A ski provided with a multiple number of spaced-apart members, preferably in the form of rotatable beveled discs mounted along the side wall of the ski at its central binding portion, with each of the members defining a lower metal apex, such as the outer peripheral edge of the beveled disc, terminating not substantially below the plane of the bottom running surface of the ski laterally spaced outwardly from the side wall, so that a line intersecting said apex and the closest adjacent point of the lower outward edge of the bottom running surface forms an acute angle of 0 to 20° with said running surface plane.

16 Claims, 6 Drawing Figures

MODIFIED SNOW SKI

This invention relates to a modified snow ski.

As the sport of snow skiing has become more popular and widespread, there has been a substantial evolution in the design and construction of skis.

Progressing from the original snow skis, which were simply in the form of long wooden slats with upwardly curved tips, modern skis are of composite construction, having fiber glass and/or metal structural bottoms and top portions separated by a core of wood, foam, honeycomb metal, or the like, and provided with a bottom running surface constructed of a plastic material which runs freely on the snow, such as polyethylene. The longitudinal edges of the bottom running surface are usually in the form of hard metal edges, generally having a right-angular profile to provide means for cutting or biting into an icy or hard-packed surface. Even though these edges may be made of hardened steel and may be well sharpened, the average skier has a good deal of difficulty in getting them to hold and check when hard-packed or icy conditions are encountered.

It is an object of our invention to modify an otherwise conventional ski, so that the average skier has little or no difficulty in getting the same to hold on slopes on which ice is encountered, which allows the skier better control on steeper and more difficult terrain.

This and still further objects will become apparent from the following description read in conjunction with the drawing, in which.

In accordance with the invention, the snow ski is modified by providing a multiple number of spaced-apart members, such as discs, mounted along the side wall of the ski at the central binding portion thereof. Each of said members defines a lower metal apex which terminates at, above, or slightly below the plane of the running surface and is laterally spaced outwardly from the side wall, so that a line intersecting said apex and the closest adjacent point of the lower outward edge of the bottom running surface forms an acute angle of 0 to 20° with said plane, and the length of said line between said intersecting points is about one-sixteenth to one-fourth of an inch.

Figure 1:
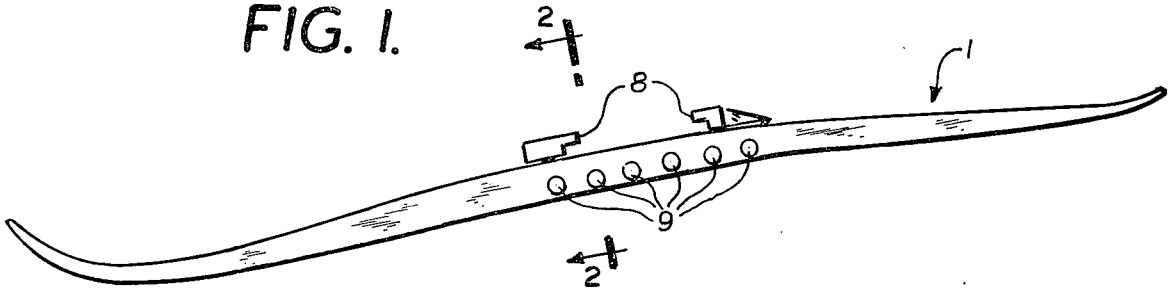
FIG. 1 is a side elevation of an embodiment of a modified ski, in accordance with the invention.
Figure 2:
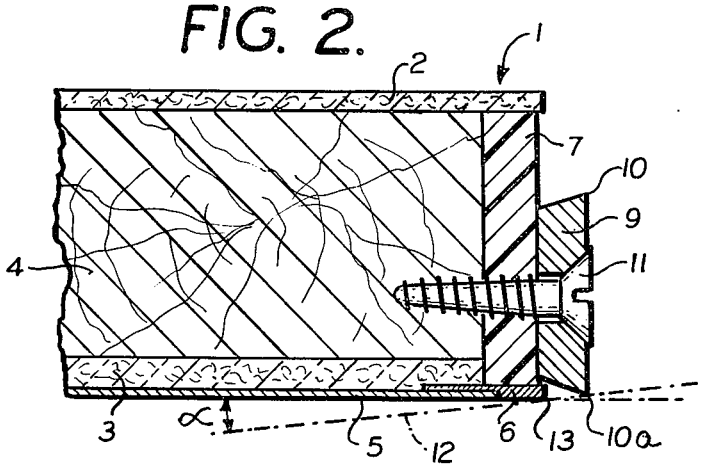
FIG. 2 is a partial cross-section of the ski shown in FIG. 1.

Referring to the embodiment as shown in FIGS. 1 and 2, 1 represents a snow ski of conventional construction which, as may be seen from FIG. 2, has a top plate 2 constructed of fiber glass, a bottom plate 3 also constructed of fiber glass, and a central core 4 of foam, soft wood, or the like. The ski is provided with a bottom running surface 5 which terminates with the lateral metal edges 6. The ski is provided with a side wall 7 of plastic material, such as phenolic, ABS plastic, or the like.

The ski bindings, diagrammatically shown at 8, are generally mounted so that the toe point is at about the center of the ski length, or in connection with shorter skis, the bindings are mounted so that the ball of the skier's foot is at about the center of the length of the running surface of the ski. The place where the binding is to be mounted, i.e., where the skier's boot is fixed to the ski, is referred to herein as the central binding portion of the ski, and this position is well understood by those skilled in the art.

In accordance with the invention, a multiple number of spaced-apart members in the form of the discs 9 are mounted along the side wall of the ski at the central binding portion. In general, at least three of these discs or other members should be provided spaced apart over a distance of at least 5 to 6 inches, and up to about 12 to 14 inches, or even greater, (though the positioning of the members over even a greater length of the ski may render the ski more difficult to turn.) While there is no exact upper limit for the number of members, it is generally not necessary to provide more than about 10. In most instances, no further advantage is provided by using more than about five or seven such members.

In the embodiment shown, 6 discs are provided which are fabricated from hardened tool steel or tungsten carbide containing metal, such as is used for cutting tools, in order to provide a very hard and wear-resistant material. The discs, however, may be made of any known or conventional material, provided that their apexes or edges 10 are of a hard metal material. Thus, they may be made of a soft, ductable metal with a hard steel rim, or may even be made of plastic, such as nylon or polycarbonate plastic (Delrin) and provided with a hard metal rim or peripherally inserted edge. While, as shown, the discs are simply drilled out and are mounted on the ski by screwing the same into the side wall and core with the screws 11, the same may be mounted in any other known or desired manner. Thus, for example, discs on opposite sides of the ski may be mounted on a shaft which is inserted through the ski. The discs may also be bonded onto the side wall of the ski.

It is only necessary that the discs be mounted on one side of each ski of the pair which are used by the skier as the inside edges. It is also possible, however, to mount corresponding pairs on opposite sides of the ski.

The diameter of the discs should, of course, be smaller than the height of the side wall 7 of the ski, and the minimum size is solely determined by structural and practical limits.

It is generally desirable to make the discs of a diameter between about 1 and one-half inch, such as about five-eighths inch; and of a thickness in excess of one-eighth inch, but generally less than one-half inch, as for example, one-fourth inch. The discs are preferably beveled, as for example, at an angle of 5 to 30° with their axes, though substantially greater or lesser bevels may be provided, and within the broadest concept of the invention, the discs may be unbeveled, with the apex 10 being simply defined by the square outer edge of the disc. The disc 9 may also be in the form of a thin disc or plate spaced from the side wall of the ski by a suitable spacer or bushing.

The disc 9 should be positioned so that the lowest point 10*a* of its apex or outer peripheral rim 10, (FIG. 2,) is not substantially below the plane of the bottom running surface and laterally spaced from the side wall, so that a line 12 intersecting this lowest point 10*a* and the closest adjacent point 13 of the lower outward edge of the bottom running surface forms an acute angle alpha of 0 to 20° and preferably 0 to 10° with the plane of the bottom running surface (FIG. 2).

While within the broadest concept of the invention, the point 10*a* can extend slightly below (up to a distance of about one-sixteenth inch) the plane of the bottom running surface of the ski, it is generally preferable that the point 10*a* be at or above the same.

As used herein and in the claims, the designation of the angle alpha of "about" 0° is intended to include a slight negative angle, i.e., with the apex of the member, such as the disc, extending slightly below the plane of the bottom running surface, as for example, up to about one-sixteenth inch below.

With an angle of greater than 0°, when the ski is running free and level, the disc 9 will not encounter the snow, but when the ski is canted at an acute angle at least equal to alpha, the disc will come in contact with the surface on which the ski is running, engaging the same and allowing the skier to check and control his turn. The exact value for the angle alpha depends on the particular desires of the skier and design of the ski. The smaller the alpha angle, the easier it is for the skier to check with very little canting of the skis, whereas with greater angles, as defined by alpha, a greater canting of the ski will be required.

When the lower edge of the disc extends slightly below the running surface, the greatest holding power is obtained, but more advanced skiers may not find this desirable, except under the most icy conditions.

Figure 6:
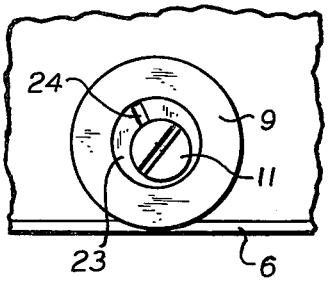
FIG. 6 is a side elevation of a modified construction of a disc, in accordance with the invention.

Within a preferred embodiment of the invention, the disc (or other member) is made vertically adjustable with respect to the plane of the bottom running surface, so that the point 10*a* of the disc 9 may be positioned and adjusted to extend from slightly below this plane to an upper position forming an angle alpha of about 10 to 20°. The adjustability can, for example, be effected by eccentrically drilling the hole through the disc 9 so that the lower point 10 is determined by its position of rotation. In this embodiment, however, the disc cannot be freely rotatably mounted on the ski. Preferably, the adjustability may be effected as shown in the embodiment of FIG. 6 by rotatably or turnably mounting the discs on a bushing 23 which, in turn, is eccentrically drilled for the screw 11. The bushing 23 may be provided with the slot 24 for turning the same and thus adjusting the height of the roller 9. The side of the bushing facing the ski may be provided with ribs, so as to secure the same in place when the screw 11 is tightened, or a ribbed washer may be provided for this purpose. Adjustment is achieved by simply loosening the screw 11 and turning the bushing 23 as desired. As shown, the lowest position of the disc is achieved with the slot 24 in the 6 o'clock position, and the highest position with the slot 24 in the 12 o'clock position.

The discs 9 are preferably mounted so that they can freely rotate on the ski as the ski is used, as this cuts down friction and constantly presents a new edge of the discs 9 when the same are in use. These discs may, however, be fixedly mounted on the ski, though, if the same do not rotate freely, it is preferable to make the same at least turnable so as to allow turning them into a position should the lower edge become dulled or injured.

Figure 4:
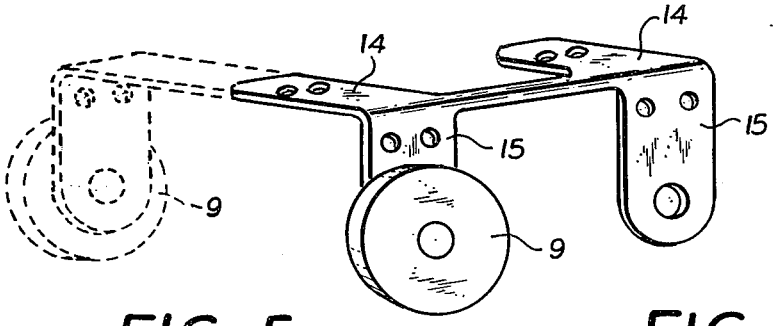
FIG. 4 is a perspective view of a still further embodiment, in accordance with the invention.

In place of mounting the discs directly on the side wall of the ski, the discs may be provided on a bracket, as shown in FIG. 4, which bracket may contain a single disc, groups of discs, or all of the discs, and which may be conveniently sold as a unit and mounted on the ski by screwing the plate 14 to the top of the ski and plate 15 into the side wall. The bracket may also be constructed so that the plate 14 extends over the entire top surface of the ski and is provided with a companion bracket 15 on the opposite side, with a companion disc, as shown in the dotted lines in FIG. 4.

Figure 3:
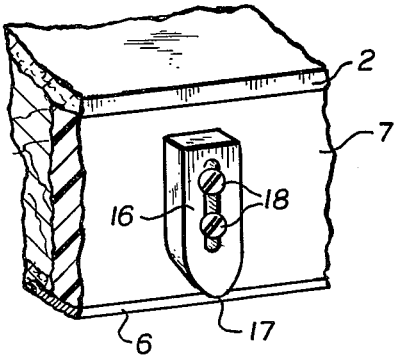
FIG. 3 is a perspective view of a portion of a ski showing a further embodiment of a modification, in accordance with the invention.
Figure 5:
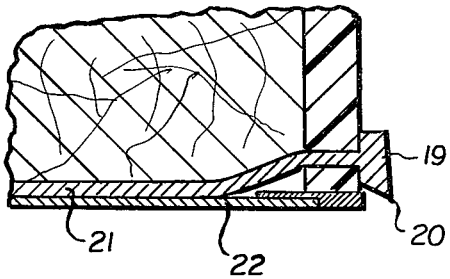
FIG. 5 is a partial cross-section of a ski showing a still further embodiment.

In place of the discs, any other members which define a lower apex corresponding to the apex 10a may be utilized. Thus, as shown in FIG. 3, the member may be in the form of a bar-shaped member 16 provided at its lower end with a bevel terminating in the curved knife edge or apex 17 and which is screwed into the side wall of the ski by the screws 18 which extend through slot so as to allow for vertical adjustment. In new ski construction, the member may be formed as an integral part of the ski. Thus, for example, as shown in FIG. 5, the member designated 19 with the apex 20 is mounted on the curved bar or plate 21 which, during the construction of the ski, is bonded to the upper surface of the bottom plate 22 of the ski with screws and/or glue in the same manner as a conventional edge is bonded and secured to the ski.

While the invention has been described in detail with reference to certain specific embodiments, various changes and modifications which fall within the spirit of the invention and scope of the appended claims will become apparent to the skilled artisan.

We claim:

1. In a snow ski having a bottom running surface and side walls, the improvement which comprises a multiple number of spaced-apart members mounted along the side wall at the central binding portion of the ski, each said member defining a lower metal apex terminating not substantially below the plane of said running surface, laterally spaced outwardly from the side wall, with a free lateral space between it and the adjacent lower outer edge of the bottom surface, so that a line intersecting said apex and the closest adjacent point of the lower outward edge of the bottom running surface forms an acute angle of about 0 to 20° with said running surface plane.

2. Improvement according to claim 1, in which said acute angle is an angle between 0 and 10°.

3. Improvement according to claim 1, in which said acute angle is an angle of between 0 and 6°.

4. Improvement according to claim 1, in which about three to 10 members are spaced apart over a length of about 5 to 14 inches.

5. Improvement according to claim 1, in which the apexes of said members are in the form of curved knife edges.

6. Improvement according to claim 1, in which said members are adjustably mounted along the side wall of said ski to vary said acute angle.

7. In a snow ski having a bottom running surface and side walls, the improvement which comprises a multiple number of spaced-apart discs mounted along the side wall at the central binding portion of the ski, said discs each having an outer peripheral metal edge extending not substantially below the plane of said running surface and laterally spaced outward from the side wall, so that a line intersecting its lowest point and the closest adjacent point of the lower outward edge of the bottom running surface forms an acute angle of about 0 to 20° with said running surface plane.

8. Improvement according to claim 7, in which each said disc is a beveled disc, with said edge being defined at its circumferential portion of greatest diameter.

9. Improvement according to claim 8, in which said peripheral metal edge is a hard metal knife edge.

10. Improvement according to claim 7, in which said discs are rotatably mounted.

11. Improvement according to claim 7, in which three to 10 discs are provided spaced apart over a length of about 5 to 14 inches.

12. Improvement according to claim 10 in which said discs are beveled discs having an outer diameter of about one-half to three-fourths inch, a thickness between about one-eighth and three-eighths inch, and beveled so that their greater diameter extends outwardly from the ski, said bevel being at an angle of 5 to 30° to their axes, and said first-mentioned angle between 0 and 10°.

13. Improvement according to claim 12, in which said discs are adjustably mounted on said wall to allow variation of said first-mentioned angle.

14. Improvement according to claim 13, in which said discs are mounted on an eccentrically turnable bushing to allow said adjustment.

15. Improvement according to claim 7, in which said discs are adjustably mounted to vary said angle.

16. Improvement according to claim 15, in which said discs are mounted on an eccentrically turnable bushing to allow said adjustment.

* * * * *